US008844144B2

(12) United States Patent
Sannah

(10) Patent No.: US 8,844,144 B2
(45) Date of Patent: Sep. 30, 2014

(54) HANDHELD CARDBOARD SCORING DEVICE

(76) Inventor: Talal Sannah, Anaheim, CA (US)

( * ) Notice: Subject to any disclaimer, the term of this patent is extended or adjusted under 35 U.S.C. 154(b) by 155 days.

(21) Appl. No.: 13/154,613

(22) Filed: Jun. 7, 2011

(65) Prior Publication Data

US 2011/0302786 A1 Dec. 15, 2011

Related U.S. Application Data

(60) Provisional application No. 61/397,503, filed on Jun. 14, 2010.

(51) Int. Cl.

| | |
|---|---|
| ***B26B 11/00*** | (2006.01) |
| ***B26F 1/32*** | (2006.01) |
| ***B26B 25/00*** | (2006.01) |
| *B26F 1/20* | (2006.01) |

(52) U.S. Cl.

CPC . *B26F 1/32* (2013.01); *B26B 11/00* (2013.01); *B26F 1/20* (2013.01); *B26B 11/001* (2013.01); *B26B 25/005* (2013.01)

USPC ..... 30/306; 30/143; 30/151

(58) Field of Classification Search

USPC ..... 30/306, 151–164, 355, 143; 83/880, 83/886

See application file for complete search history.

(56) References Cited

U.S. PATENT DOCUMENTS

| | | | | | |
|---|---|---|---|---|---|
| 1,528,615 | A | * | 3/1925 | Janecek | 30/307 |
| 1,535,816 | A | * | 4/1925 | Dabney | 33/42 |
| 1,990,967 | A | * | 2/1935 | Wenzel | 30/347 |
| 4,974,320 | A | * | 12/1990 | Pelletier | 30/123 |
| 5,778,536 | A | * | 7/1998 | West | 30/123 |
| D557,583 | S | * | 12/2007 | Lewis et al. | D8/95 |
| 7,526,865 | B2 | * | 5/2009 | Mueller | 30/123 |

* cited by examiner

*Primary Examiner* — Omar Flores Sanchez

(57) ABSTRACT

A handheld cardboard scoring device includes a handle; an arched, stiff frame extending from the handle; a circular scoring blade having a central axis and an outer edge; a hub on the frame that rotatably connects to the axis of the blade; and a plurality of teeth along the outer edge of the blade. There may be substantially five teeth per inch on the outer edge of the circular scoring blade.

2 Claims, 2 Drawing Sheets

HANDHELD CARDBOARD SCORING DEVICE

RELATED APPLICATIONS

This application claims the benefit of the filing date of U.S. patent application Ser. No. 61/397,503, filed Jun. 14, 2010, which is incorporated herein by reference in its entirety.

BACKGROUND OF THE INVENTION

The present invention generally relates to handheld tools and more specifically to a handheld cardboard scoring device.

Cardboard boxes need scored edges to bend and create walls. When adjustments are needed for a specific box, normally, people might try to softly cut one side with a knife or box cutter in order to achieve a corded edge and bend the material. Often, the cut is too deep and the material must be cut off of the remaining box.

It would be desirable to have a device that easily scored cardboard boxes so the box can be folded.

SUMMARY OF THE INVENTION

In one aspect of the present invention, a device includes a handle; an arched, stiff frame extending from the handle; a circular scoring blade having a central axis and an outer edge; a hub on the frame that that rotatably connects to the axis of the blade; and a plurality of teeth along the outer edge of the blade.

In another aspect of the present invention, a method of scoring a cardboard material includes rotatably attaching a circular scoring blade having teeth along an outer edge; gripping the handle; applying the blade to the cardboard material; and rolling the blade against the material; wherein the teeth are small enough that the blade scores the surface of the cardboard material without cutting the material into separate pieces.

DETAILED DESCRIPTION

The preferred embodiment and other embodiments, which can be used in industry and include the best mode now known of carrying out the invention, are hereby described in detail with reference to the drawings. Further embodiments, features and advantages will become apparent from the ensuing description, or may be learned without undue experimentation. The figures are not necessarily drawn to scale, except where otherwise indicated. The following description of embodiments, even if phrased in terms of "the invention" or what the embodiment "is," is not to be taken in a limiting sense, but describes the manner and process of making and using the invention. The coverage of this patent will be described in the claims. The order in which steps are listed in the claims does not necessarily indicate that the steps must be performed in that order.

An embodiment of the present invention generally provides a handheld cardboard scoring device is used to score any cardboard material in order to bend and fold cardboard corrugated material into different shapes and forms.

An embodiment of a device may be used to make boxes and/or make adjustments to cardboard boxes. Scoring, as used here, is defined as making parallel cuts or incisions in cardboard material in order for the material to bend without breaking. An embodiment might avoid making a solid cut into the cardboard and would not cut through the cardboard material.

Embodiments may allow for scoring without cutting. Embodiments may also allow someone to make a box by hand without using equipment or machinery, since cardboard boxes need scored edges to bend and create walls.

Figure 1:
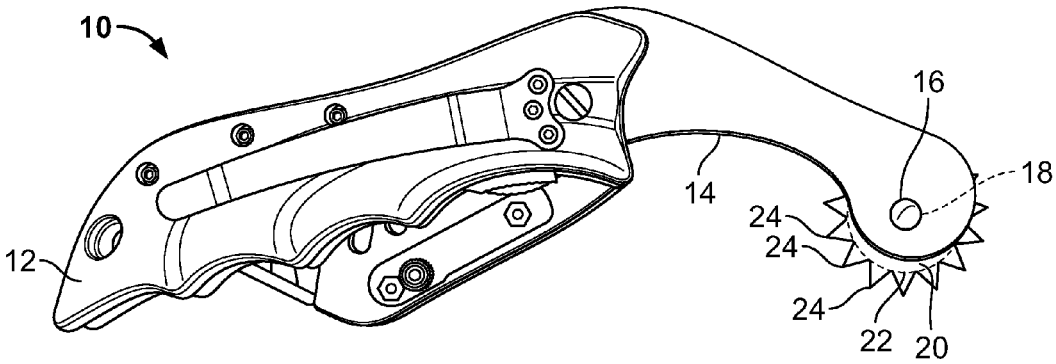
FIG. 1 depicts a side view of an embodiment of the present invention.
Figure 2:
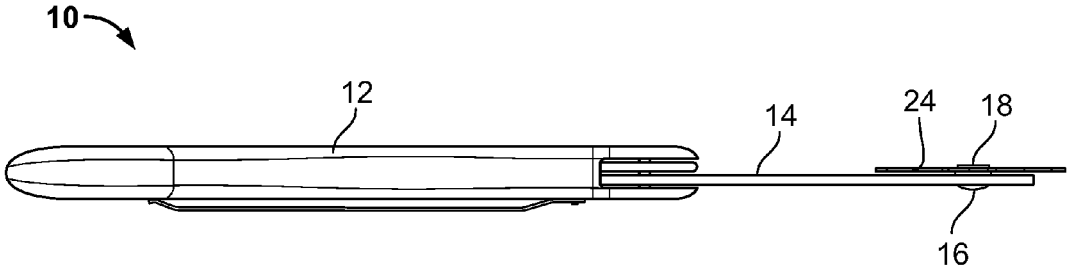
FIG. 2 depicts a top view of the embodiment of FIG. 1.

As depicted in FIGS. 1 and 2, an embodiment of a handheld cardboard scoring device 10 may include an elongate handle 12, with an arched metal frame 14 extending out of the top of the handle 12, and a hub 16 with a central axis 18 connecting the rotating circular scoring blade 20 to the metal frame 14. An embodiment of a circular blade may have a diameter, for example, of 2" to 3", and preferably about 2.5". Along the outermost circumference 22 of the cutting blade/wheel 20 may be teeth 24, which are small sharp points along the cutting side of the saw. An embodiment may have, for example, five to six, preferably five, teeth per any one inch of the circular saw blade. Embodiments of the teeth may have a shape that is triangular, with a length from top-to-bottom of approximately from 1" to 1.5", preferably about 1.25".

Figure 3:
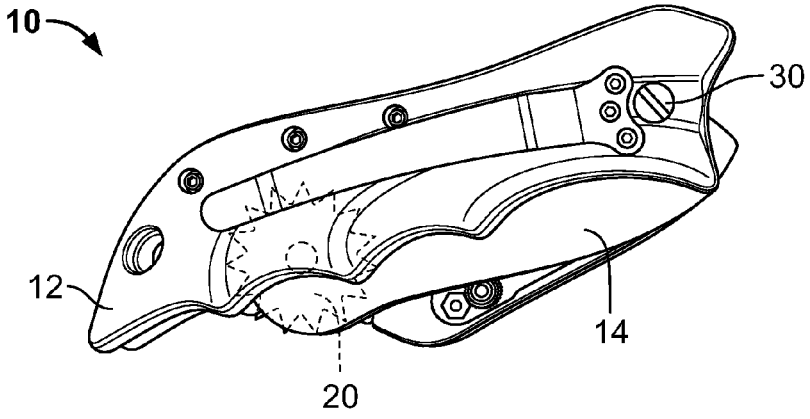
FIG. 3 depicts a side view of the embodiment the present invention in folded position.

As depicted in FIG. 3, an embodiment of a handheld cardboard scoring device 10 may further include a release switch 30 or button, and when the release switch 30 is activated, the arched metal frame 14 may fold into the body of the handle 12 for storage.

Figure 4:
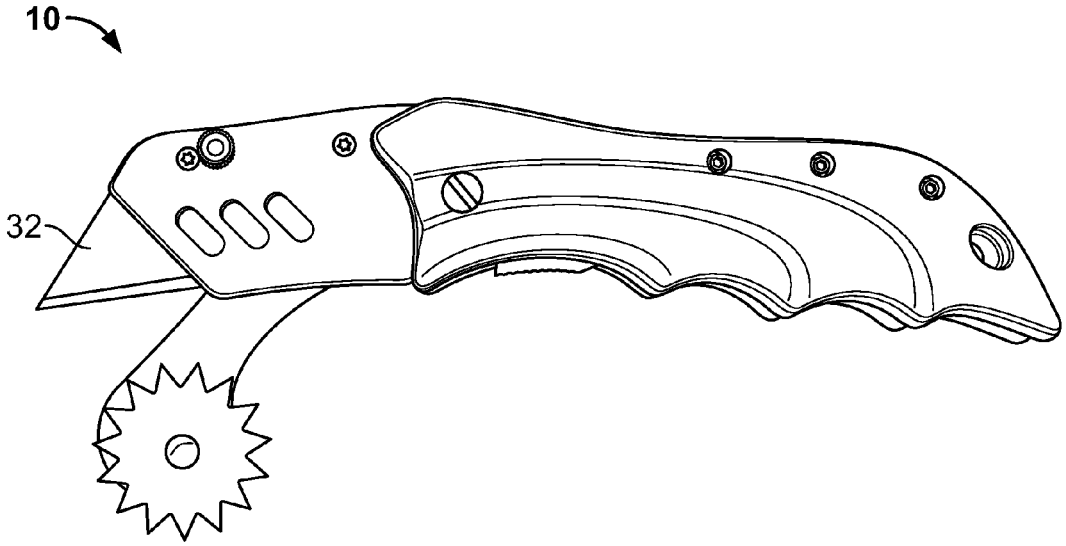
FIG. 4 depicts a side view of an embodiment of the present invention with a box cutter.

As depicted in FIG. 4, an embodiment of a handheld cardboard scoring device 10 may further include a retractable box cutter blade 32.

Embodiments of the device may be used by gripping the handle, applying the blade to the cardboard material, and rolling the blade against the material to achieve the desired "score".

I claim:

1. A method of shaping a corrugated cardboard material, comprising:

identifying a line upon which the cardboard is to be folded;

utilizing a device that includes a handle, an arched, stiff frame extending from the handle, a circular scoring blade having a central axis and an outer edge, a hub on the frame that that rotatably connects to the axis of the blade; and a plurality of teeth along the outer edge of the blade to score the surface of the cardboard material without cutting the inner, corrugated layer; and folding the cardboard material along the scored surface.

2. The method of claim 1, wherein the device has substantially five teeth per inch on the outer edge of the circular scoring blade.

* * * * *